US006161911A

United States Patent [19]

Minemoto et al.

[11] Patent Number: 6,161,911

[45] Date of Patent: Dec. 19, 2000

[54] INK JET RECORDING DEVICE

[75] Inventors: Hitoshi Minemoto; Yoshihiro Hagiwara; Junichi Suetsugu; Tadashi Mizoguchi; Hitoshi Takemoto; Kazuo Shima; Toru Yakushiji; Tomoya Saeki, all of Kashiwazaki, Japan

[73] Assignee: NEC Corporation, Tokyo, Japan

[21] Appl. No.: 08/990,378

[22] Filed: Dec. 15, 1997

[30] Foreign Application Priority Data

Dec. 13, 1996 [JP] Japan ..... 8-333208

[51] Int. Cl.[7] ..... B41J 2/195

[52] U.S. Cl. ..... 347/7

[58] Field of Search ..... 347/7, 84, 85; 399/57–58, 62, 64

[56] References Cited

U.S. PATENT DOCUMENTS

| | | | |
|---|---|---|---|
| 4,882,596 | 11/1989 | Tsuzuki et al. | 347/85 |
| 5,155,528 | 10/1992 | Morishige et al. | 399/64 |
| 5,781,828 | 7/1998 | Caruthers, Jr. et al. | 399/58 |
| 5,905,510 | 5/1999 | Hagiwara et al. | 347/7 |

FOREIGN PATENT DOCUMENTS

| | | |
|---|---|---|
| 57-70667 | 1/1982 | Japan . |
| 4-501987 | 4/1992 | Japan . |
| 4-106573 | 8/1992 | Japan . |

*Primary Examiner*—John Barlow
*Assistant Examiner*—Juanita Stephens
*Attorney, Agent, or Firm*—Hutchins, Wheeler & Dittmar

[57] ABSTRACT

An ink jet recording device comprises a recording head for ejecting pigmented ink in an ink chamber, an ink reservoir for circulating the pigmented ink between the ink chamber and the ink reservoir, and a replenishment tank for replenishing concentrated pigmented ink to the ink reservoir. The replenishment of the concentrated pigmented ink is effected by a piezoelectric element for reducing the volume of the replenishment tank upon receiving a driving signal. The concentration of colored particles in the concentrated pigmented ink is equal to the concentration of the colored particles in the ink droplet ejected from the ink chamber.

12 Claims, 5 Drawing Sheets

INK JET RECORDING DEVICE

BACKGROUND OF THE INVENTION (a) Field of the Invention

The present invention relates to an ink jet recording device and, more particularly, to an ink jet recording device wherein recording is effected by ejecting colored particles in pigmented ink onto a recording sheet (b) Description of the Related Art Non-impact recording method attracts a large attention in a printing technology for its low noise during a recording operation. Among other non-impact recording methods, an ink jet recording method has several advantages such as direct and high-speed printing onto a recording sheet such as a plain paper. A variety of proposals are presented heretofore for improving ink jet recording devices implementing the ink jet recording method.

In a conventional ink jet recording device, colored particles in a pigmented ink received in an ink chamber are ejected from an ink jet slit by using an electrophoretic force and an electrostatic force to form images on a recording sheet based on print data. In the ink jet recording device, if the density or concentration of the colored particles in the pigmented ink is reduced as a result of the consumption of the colored particles, there arises a problem in that a stable printing cannot be obtained.

The problem reduction of the concentration of the colored particles in the pigmented ink may be solved by replenishment of the concentrated pigmented ink. Patent Publication JP-A-4(1992)-106573 proposes a replenishment device for replenishing a developer in an photocopying machine. FIG. 1 shows a schematic block diagram of the proposed replenishment device, wherein the device comprises an developer tank 10 communicated with a chamber in the recording head (not shown in the drawing), an optical densitometer 15 immersed in the developer 11 received in the developer tank 10, a replenishment tank 16 for receiving therein concentrated developer 12 for replenishment, and a controller 24 for controlling the amount of concentrated developer 12 to be replenished from the replenishment tank 16 through a tube 13 to the developer tank 10 by controlling a control valve 14.

The control unit 24 comprises a comparator 23, a reference concentration signal generator 22, and a counter 21 for counting the number of copied sheets to supply a count signal 18 to the reference concentration signal generator 22. The reference concentration signal generator 22 calculates, based on the count signal 18 and a normal reference concentration to be applied, a corrected reference concentration value, which is supplied to the reference terminal of the comparator 23 as a reference concentration signal 19. The concentration of the toner in the developer 11, which is detected by the optical densitometer 15, is supplied to the signal terminal of the comparator 23 as a detected concentration signal 17.

The comparator 23 compares the detected concentration signal 17 against the reference concentration signal 19 to deliver a valve control signal 20 to the control valve 14 to open the control valve 14 if the detected concentration signal 17 is lower than the reference concentration signal 19, thereby replenishing the concentrated developer 12 from the replenishment tank 16 to the developer tank 10.

In the proposed device, the toner concentration in the developer 11 can be maintained roughly at a constant level by replenishing the concentrated developer 12. However, the control of the toner concentration at a precise level by adjusting the valve opening is difficult in fact.

Moreover, the reference concentration signal for the comparator is corrected simply based on the number of the recorded sheets. However, the amount of the toner in the developer consumed by recording is not precisely calculated based on the number of recorded sheets.

Therefore, it is difficult to expect a fine control of the toner concentration in the developer by the configuration of the proposed device in the copying machine.

SUMMARY OF THE INVENTION

It is therefore an object of the present invention to provide an improved ink jet recording device having an ink supply system which is capable of maintaining the concentration of the colored particles in the pigmented ink in the ink chamber at a constant level.

The present invention provides an ink jet recording device comprising an ink jet recording head defining an ink chamber for receiving therein pigmented ink and an ink jet slit, communicated to the ink chamber, for ejecting an ink droplet of pigmented ink therethrough, the pigmented ink including colored particles therein, an ink reservoir, communicated to the ink chamber, for supplying the pigmented ink to the ink chamber, a replenishment tank communicated with the ink reservoir and receiving therein concentrated pigmented ink, a control section for outputting a control signal for controlling a concentration of the colored particles in the pigmented ink, and a piezoelectric element for responding to the control signal to supply the concentrated pigmented ink in the replenishment tank to the ink reservoir.

In accordance with the ink jet recording device according to the present invention, the piezoelectric element responds to a control signal to replenish the concentrated pigmented ink to the ink reservoir in a more accuracy so that the concentration of the colored particles in the pigmented ink can be maintained at an accurate level.

The above and other objects, features and advantages of the present invention will be more apparent from the following description, referring to the accompanying drawings.

PREFERRED EMBODIMENTS OF THE INVENTION

Figure 1:
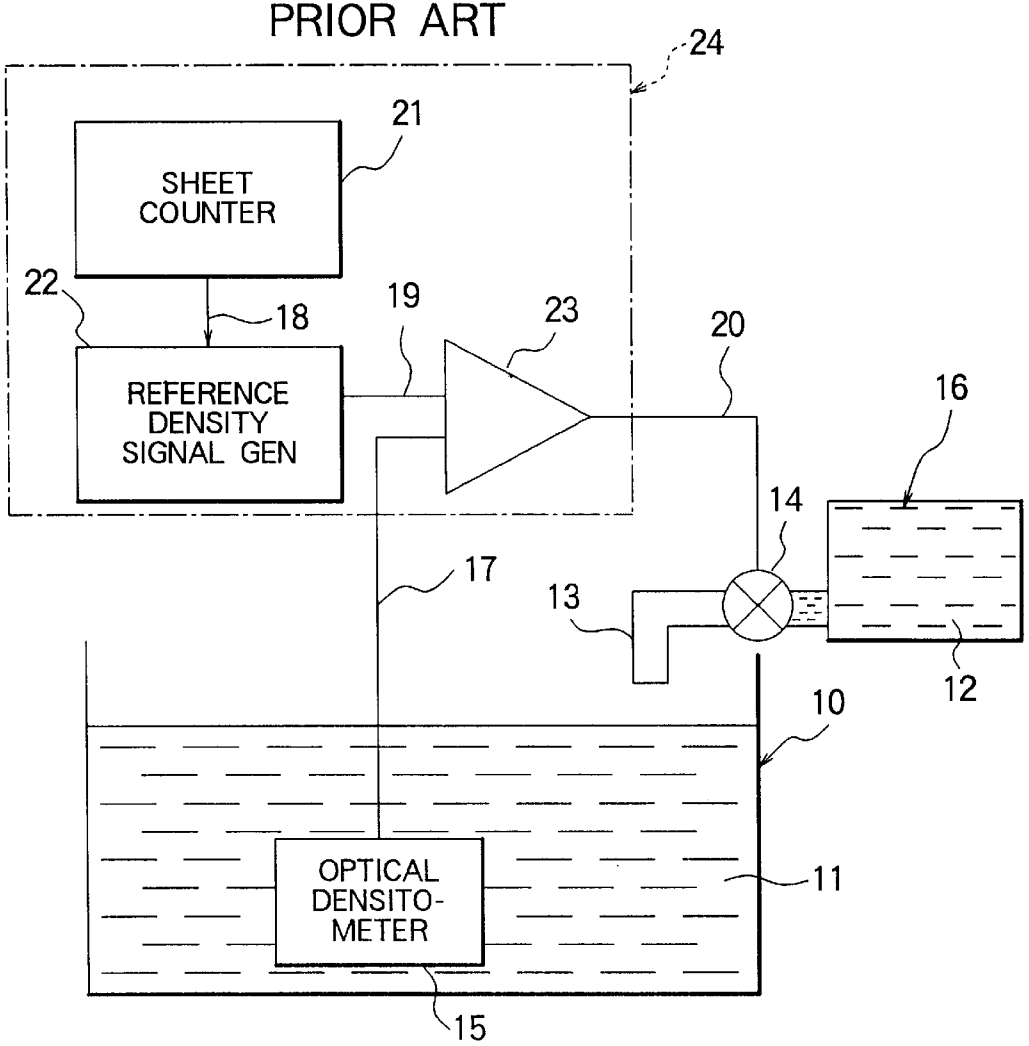
FIG. 1 PRIOR ART
FIG. 1 is a schematic diagram of a conventional developer replenishment device in a photocopying machine.

Now, the present invention is more specifically described with reference to accompanying drawings, wherein similar constituent elements are designated by the same or similar reference numerals.

Figure 2:
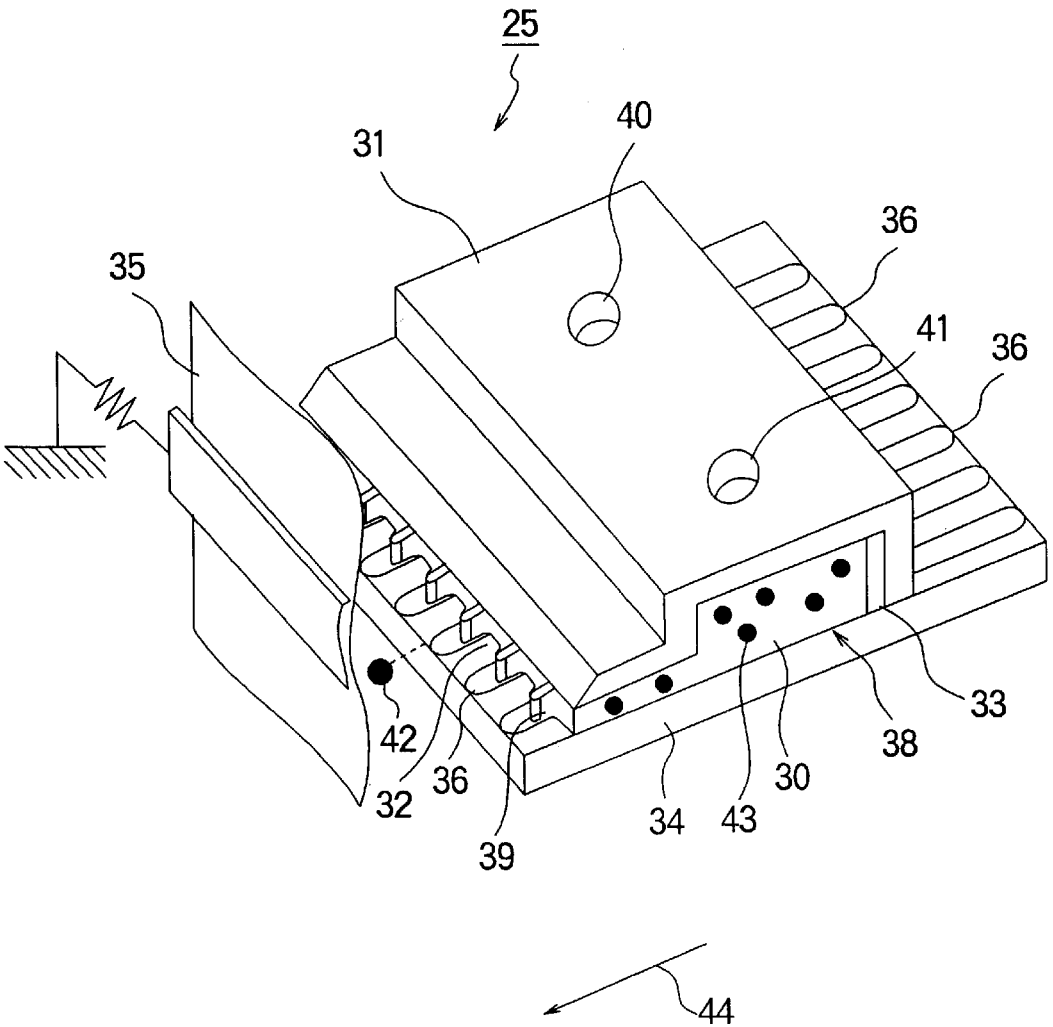
FIG. 2 is a perspective view of an ink jet recording head in an ink jet recording device according to a first embodiment of the present invention.

Referring to FIG. 2, an ink jet recording head 25 in an ink jet recording device according to a first embodiment of the present embodiment comprises a top cover 31 and a bottom cover 34 for defining an ink chamber 38 therebetween, wherein a planar electrophoretic electrode 33 is disposed on the rear wall of the ink chamber 38. A plurality of elongate ejecting electrodes 36 are arranged on the bottom cover 34 at a constant pitch in a direction normal to the direction 44 of the ejection of the ink droplet 42. A meniscus element 39 is disposed on each of the front tip portions of the ejecting electrodes 36. A planar counter electrode 37 is disposed in a spaced relationship with the front tips of the ejecting electrodes 36.

An ink ejecting slit 32 formed at the front edge of the ink chamber 38 between the top cover 31 and the bottom cover 34 is separated by the meniscus elements 39 corresponding to the ejecting electrodes 36, whereby a meniscus of the pigmented ink is formed on each of the tips of the ejecting electrodes 36 at the ink ejecting slit 32. The top cover 31 has therein an ink inlet port 40 and an ink outlet port 41 communicated with the ink chamber 38.

Figure 4:
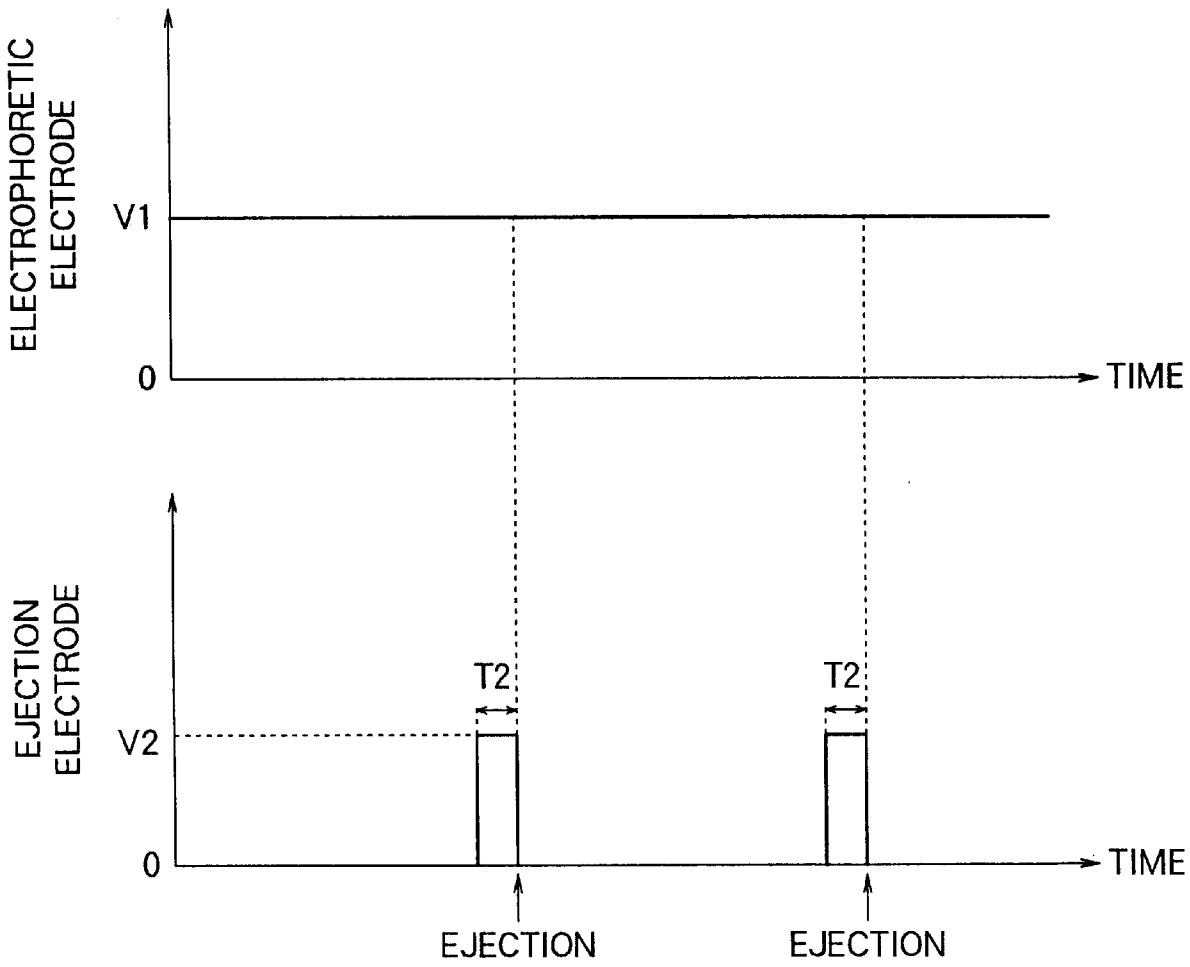
FIG. 4 PRIOR ART
FIG. 4 is a timing chart of signals in a general ink jet recording head such as shown in FIG. 3.

In operation of a general ink jet recording head including the recording head 25 shown in FIG. 2, an electrophoretic force is used for moving electrified color particles in the pigmented ink toward the ink jet slit 32. Specifically, when an electrophoretic voltage Vl such as shown in FIG. 4 is applied to the electrophoretic electrode 33, a constant electric field is generated in the ink chamber 38 receiving therein pigmented ink 30 including electrified colored particles 43. After the pigmented ink 30 forms an ink meniscus at each tip of the ink ejection electrodes 36, the colored particles 43 are moved toward the ink ejection slit 32 by the electric field at an electrophoretic speed corresponding to the electric field.

When an ejecting pulse train having a voltage of V2 and a duration of T2 as shown in FIG. 4 is applied to a specified ejecting electrode 36, an electrostatic force acts on the colored particles 43 to further move toward the tip of the specified ejecting electrode 36, whereby the colored particles 43 are concentrated in the vicinity of the tip. After the electrostatic force exceeds the surface tension and viscosity of the ink meniscus, an ink droplet 42 is ejected at the timing of the falling edge of each ejecting pulse V2, as shown in FIG. 4, toward a recording sheet 35 and attached thereto. By repeating the application of the ejecting pulse to the ejecting electrodes while supplying the pigmented ink from the ink reservoir, images or characters are recorded on the recording sheet based on the print data.

The ink droplet 42 contains m1% of colored particles and m2% of insulating solvent wherein m1+m2=100, whereas the pigmented ink in the ink chamber contains M1% of colored particles and M2% of insulating solvent, wherein M1+M2=100 and m1>M1. Accordingly, after printing for some recording sheets, the difference in the ratio causes a reduction in the ratio of the colored particles 43 in the pigmented ink 30 in the ink chamber 38, which degrades the image quality and stable printing.

In the ink jet recording device according to the present embodiment, in order to cancel the reduction in the concentration of the colored particles, concentrated pigmented ink for replenishment includes m1% of colored particles and m2% of insulating solvent, which are experimentally determined beforehand, to maintain a constant concentration of the colored particles 43 in the pigmented ink 30.

Figure 3:
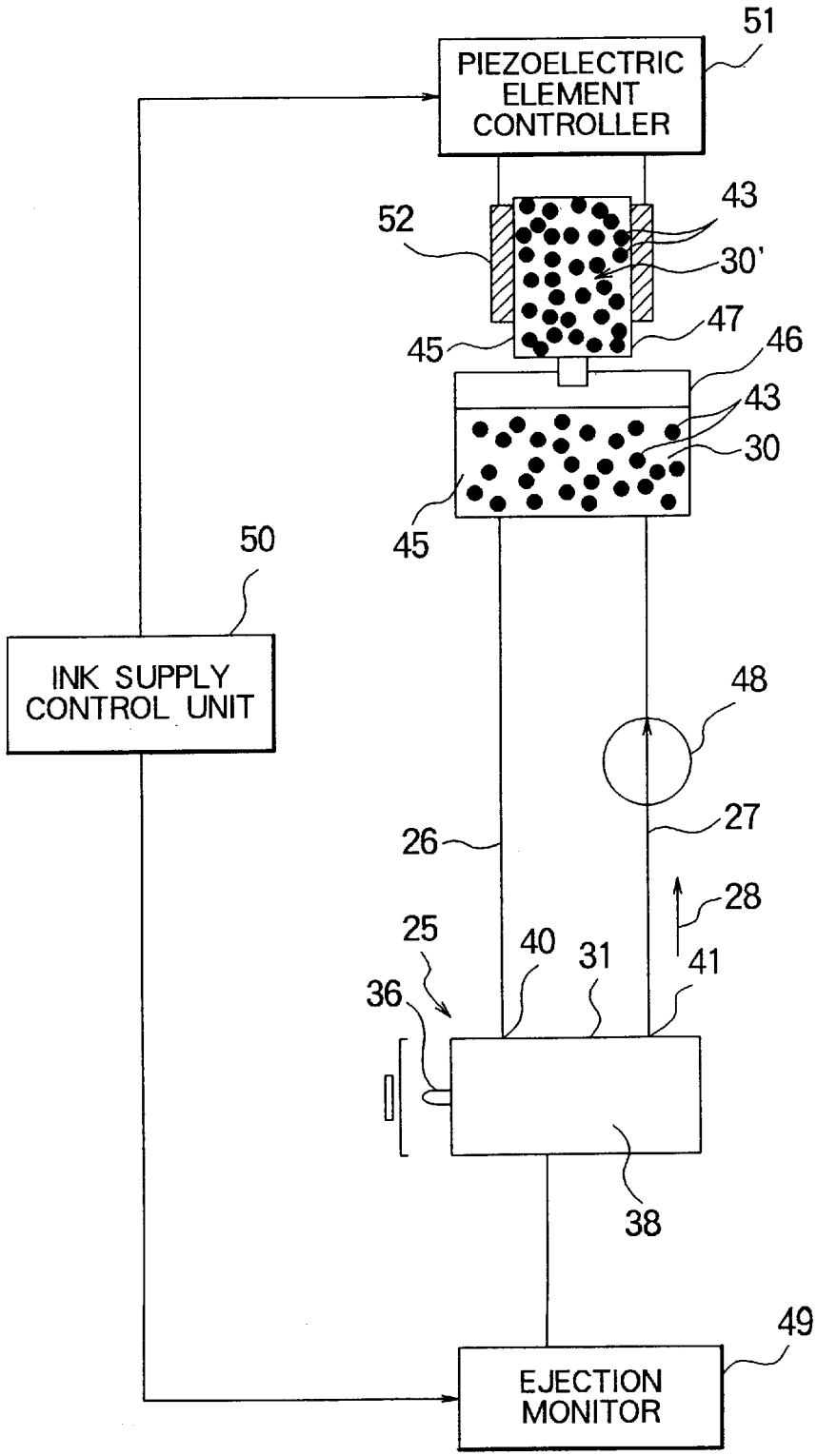
FIG. 3 is a schematic block diagram of an ink supply system for replenishing a concentrated pigmented ink in the ink jet recording device of FIG. 2.

Referring to FIG. 3 showing a schematic block diagram of an ink supply system for supplying pigmented ink to the ink jet recording head 25 of FIG. 2, the ink inlet port 40 and the ink outlet port 41 of the ink chamber 38 are communicated with an ink reservoir 46 through tubes 26 and 27, respectively. A pump 48 is provided within the tube 27 for circulation of the pigmented ink between the ink chamber 38 and the ink reservoir 46 in the direction shown by arrows 28. The ink reservoir 46 receives therein pigmented ink 30 wherein colored particles 43 are dissolved in an insulating solvent 45. The ink reservoir 46 is supplied with concentrated pigmented ink 30', which includes m1% of colored particles 43 and m2% of insulating solvent 45, from a replenishment tank 47 for replenishment. The replenishment tank 47 is made of an elastic material having a cylindrical shape. The cylindrical wall of the replenishment tank 47 is provided with a pair of piezoelectric elements 52, which are capable of thrusting the replenishment tank 47 to discharge the concentrated pigmented ink 30' in the replenishment tank 47 to the ink reservoir 46 for replenishment of the pigmented ink.

The ink supply system also comprises, for controlling the concentration of the colored particles 43 in the ink chamber 38, an ejection monitor 49 for monitoring or counting the number of ejection times by the ejecting slit based on the number of the ejecting pulses (shown in FIG. 4) applied to the ejecting electrodes 36, a piezoelectric element controller 51 for controlling the voltage applied to the piezoelectric element 52, an ink supply control unit 50 for controlling the piezoelectric element controller 51 based on the signal supplied from the ejection monitor 49.

The ink supply control unit 50 reads the number of ejection times from the ejection monitor 49 at a specified timing, calculates the amount of pigmented ink consumption in the ink reservoir 46 and resets the count in the ejection monitor 49.

If the ink supply control unit 50 judges, based on the calculated result, that replenishment from the replenishment tank 47 to the ink reservoir 46 is necessary for maintaining the image quality, the ink supply control unit 50 transmits a control signal which corresponds to the amount of the consumption of the pigmented ink 30. The piezoelectric element controller 51 supplies a driving voltage signal corresponding to the amount of ink consumption to the piezoelectric element 52, which shrink the replenishment tank 47 for discharge of the specified amount of the concentrated pigmented ink 30' from the replenishment tank 47 by thrusting the cylindrical wall of the replenishment tank 47. As a result, the concentration of the colored particles 43 in the ink reservoir 46 and also in the ink chamber 38 are recovered. By repeating the above operation at a specified timing, the concentration of the colored particles in the pigmented ink in the ink chamber 38 is maintained at a constant. New concentrated pigmented ink may be also replenished to the replenishment tank 47 after each replenishment from the replenishment tank 47.

Figure 5:
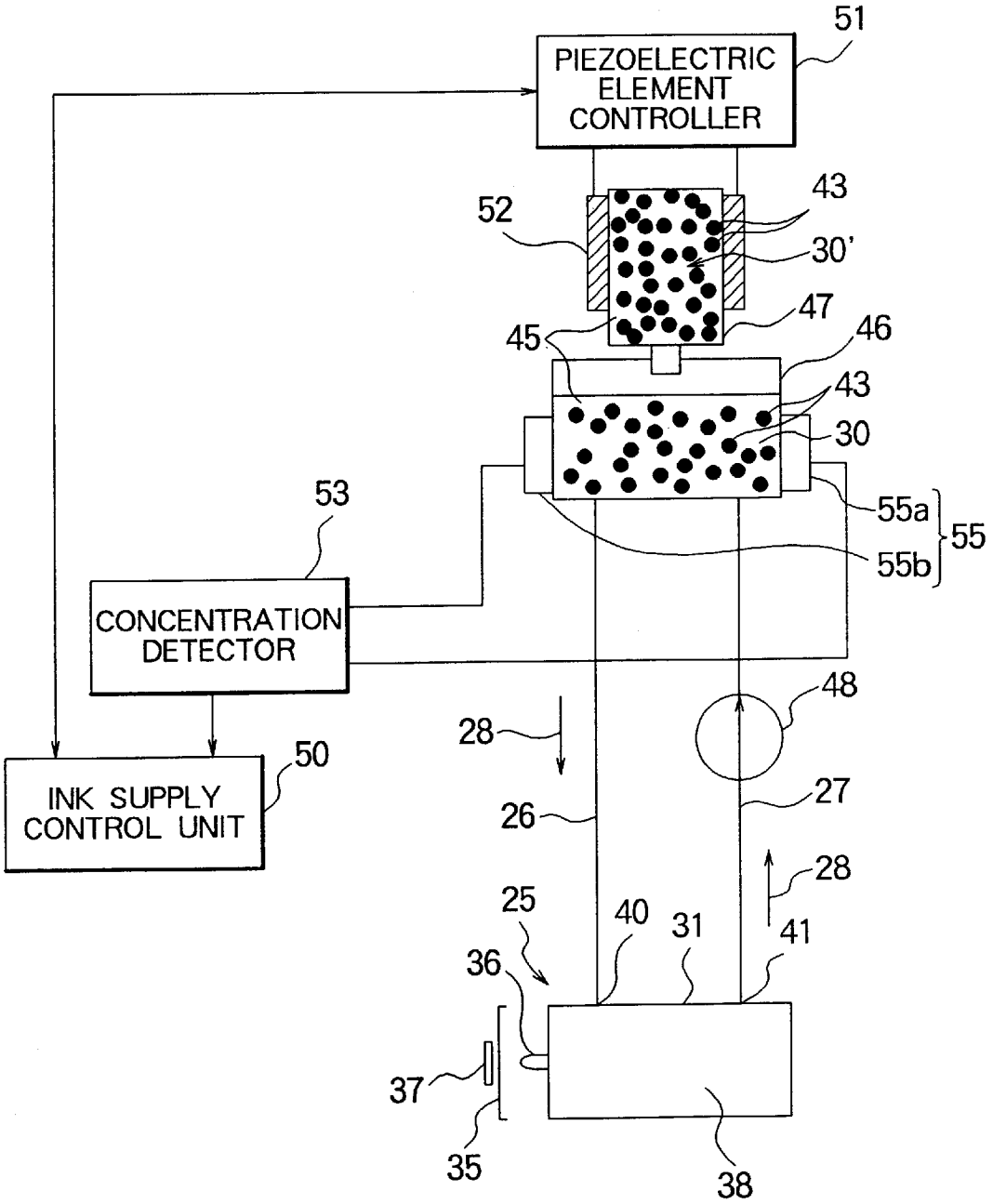
FIG. 5 is a schematic diagram of an ink supply system for replenishing concentrated pigmented ink in an ink jet recording device according to a second embodiment of the present invention.

Referring to FIG. 5, an ink jet recording device according to a second embodiment of the present invention is similar to the first embodiment except for an optical sensor 55 and a concentration detecting section 53 provided in the present embodiment instead of the ejection monitor 49 in the first embodiment. The optical sensor 55 including a light source **55*a* and a photodetector 55*b* detects transparency of the pigmented ink 30 in the ink reservoir 46 based on the amount of light received by the photodetector 55*b***.

The concentration detecting section 53 outputs a signal representing the concentration of the colored particles 43 in the pigmented ink 30 in the ink reservoir 46. The ink supply control unit 50 supplies a control signal to the piezoelectric controller 51 at a specified timing based on the concentration signal supplied from the concentration detecting section 53.

The piezoelectric element controller 51 supplies a driving voltage signal specified by the ink supply control unit 50 to the piezoelectric element 52, to maintain the concentration of the colored particles 43 in the pigmented ink 30 in the ink reservoir 46 and in the ink chamber 38 at a constant.

In an alternative arrangement in the above embodiments, the piezoelectric element may be a piston disposed in the cylindrical replenishment tank, wherein the deformation or extension of the piston by applying the driving voltage is used to discharge the concentrated pigmented ink from the cylinder.

Since the above embodiments are described only for examples, the present invention is not limited to the above embodiments and various modifications or alterations can be easily made therefrom by those skilled in the art without departing from the scope of the present invention.

What is claimed is:

1. An ink jet recording device comprising an ink jet recording head defining an ink chamber for receiving therein pigmented ink and an ink jet slit, communicated to said ink chamber, for ejecting an ink droplet of pigmented ink there through, said pigmented ink including colored particles therein, an ink reservoir, communicated to said ink chamber, for supplying the pigmented ink to said ink chamber, a replenishment tank communicated with said ink reservoir and receiving therein concentrated pigmented ink, a control section for outputting a control signal for controlling a concentration of said colored particles in said pigmented ink, and a piezoelectric element operatively coupled to said control section for responding to said control signal to supply said concentrated pigmented ink in said replenishment tank to said ink reservoir.

2. An ink jet recording head as defined in claim 1, wherein said control section includes a monitor for counting a number of ejection times by said ejection slit.

3. An ink jet recording head as defined in claim 1, wherein said control section includes an optical sensor disposed in said ink reservoir for detecting the concentration of said colored particles in said pigmented ink.

4. An ink jet recording head as defined in claim 1, wherein a concentration of colored particles in said concentrated pigmented ink is substantially equal to a concentration of the colored particles in said ink droplet.

5. An ink jet recording apparatus, comprising:

an ink reservoir;

an ink jet recording head, in fluid communication with said ink reservoir, said ink jet recording head ejecting ink therefrom;

an ejection monitor, coupled to said ink jet recording head to monitor an amount of ink ejected therefrom;

an ink supply control unit, coupled to said ejection monitor to cause ink to be provided to said ink reservoir in response to said ejection monitor indicating that a predetermined amount of ink has been ejected from said ink jet recording head;

a replenishment tank in fluid communication with said ink reservoir to provide ink thereto;

at least one piezoelectric element, coupled to said replenishment tank to cause ink to flow from said replenishment tank to said ink reservoir; and a piezoelectric element controller, coupled to said ink supply control unit and said at least one piezoelectric element to actuate said at least one piezoelectric element according to a signal provided by said ink supply control unit.

6. An ink recording apparatus, according to claim 5, further comprising:

a plurality of ejecting electrodes that cause ink droplets to be ejected from said ink jet recording head.

7. An ink jet recording apparatus, according to claim 6, wherein said ejection monitor provides an output that varies according to a number of ink droplets ejected from said ink jet recording head by said ejecting electrodes.

8. An ink jet recording apparatus, comprising:

an ink reservoir;

an ink jet recording head, in fluid communication with said ink reservoir, said ink jet recording head ejecting ink therefrom;

a concentration detector, coupled to said ink reservoir to monitor ink in said ink reservoir;

an ink supply control unit, coupled to said concentration detector to cause ink to be provided to said ink reservoir in response to said concentration detector indicating that a concentration of ink in said ink reservoir is less than a predetermined amount;

a replenishment tank in fluid communication with said ink reservoir to provide ink thereto;

at least one piezoelectric element, coupled to said replenishment tank to cause ink to flow from said replenishment tank to said ink reservoir; and a piezoelectric controller, coupled to said ink supply control unit and said at least one piezoelectric element to actuate said at least one piezoelectric element according to a signal provided by said ink supply control unit.

9. An ink jet recording apparatus comprising;

an ink reservoir;

an ink jet recording head having an ink chamber in fluid communication with said ink reservoir, said ink jet recording head ejecting ink from said ink chamber;

a concentration detector, coupled to said ink reservoir to monitor ink in said ink reservoir, wherein said concentration detector includes an optical sensor to measure the concentration of ink in said ink reservoir by detecting the transparency thereof;

at least one piezoelectric element, in fluid communication with said ink reservoir to cause ink to flow thereto; and an ink supply control unit, coupled to said concentration detector that provides a signal to said piezoelectric element to cause ink to be provided to said ink reservoir in response to said concentration detector indicating that a concentration of ink in said ink reservoir is less than a predetermined amount, wherein said concentration detector indicates an amount of ink to be provided that varies according to transparency of ink in said reservoir.

10. An ink jet recording apparatus, comprising:

ink reservoir means for storing ink;

recording head means having ink chamber means in fluid communication with said ink reservoir means, for ejecting ink from said ink chamber means;

detection means for detecting an amount of ink used by said recording head means, wherein said detection means includes an optical sensor that measures a concentration of ink in said ink reservoir means, by detecting the transparency thereof;

piezoelectric element means, in fluid communication with said ink reservoir means, for causing ink to flow thereto; and control means, coupled to said detection means, for providing a signal to said piezoelectric means to cause ink to be provided to said ink reservoir means in response to said detection means indicating that a predetermined amount of ink has been used by said recording head means, wherein said detection means indicates an amount or ink to be provided that varies according to transparency of ink in said reservoir.

11. An ink jet recording apparatus, according to claim 10, wherein said optical sensor includes a light source and a photo detector and wherein an amount of light from said light source that is received by the photo detector varies according to transparency of pigmented ink within said ink reservoir means.

12. A method of maintaining an ink reservoir for an ink jet recording apparatus, comprising:

measuring an amount of ink used by the ink jet recording apparatus by detecting at least one of: an amount of ink ejected by an ink jet recording head of the ink jet recording apparatus and a concentration of ink in the ink reservoir; and replenishing the ink jet reservoir in response to the ink jet recording apparatus using a predetermined amount of ink, wherein replenishing the ink jet reservoir includes providing a signal to at least one piezoelectric element that causes ink to flow from a replenishment tank to the ink reservoir.

* * * * *